US005865851A

United States Patent [19]

Sidoti et al.

[11] Patent Number: 5,865,851

[45] **Date of Patent: *Feb. 2, 1999**

[54] HOME DRY CLEANING COMPOSITIONS

[75] Inventors: Anthony Domenic Sidoti, Pompton Plains; Michael Richard Tyerech, Fort Lee; Tracy Ann Ryan, Rivervale; Frank Anthony Lucia, III, Oak Ridge; Jeanne Marie Weller, Glen Rock, all of N.J.

[73] Assignee: Reckitt & Colman Inc., Wayne, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 666,689

[22] Filed: Jun. 18, 1996

[51] Int. Cl.[6] ..... C11D 3/26; C11D 7/32; D06L 1/04

[52] U.S. Cl. ..... 8/142; 8/137; 510/276; 510/281; 510/282; 510/283; 510/284; 510/285; 510/289; 510/291; 510/293; 510/295

[58] Field of Search ..... 8/137, 142; 510/276, 510/281, 282, 283, 284, 285, 289, 293, 295, 291

[56] References Cited

U.S. PATENT DOCUMENTS

| | | | |
|---|---|---|---|
| 2,327,182 | 7/1943 | Flett . | |
| 2,327,183 | 8/1943 | Flett . | |
| 2,697,075 | 12/1954 | Echols . | |
| 3,067,144 | 12/1962 | Michaels . | |
| 3,401,007 | 9/1968 | Hoffman et al. | 8/137 |
| 3,432,253 | 3/1969 | Dixon et al. . | |
| 3,609,089 | 9/1971 | Cantrell et al. | 510/242 |
| 3,697,453 | 10/1972 | Tate et al. . | |
| 3,748,268 | 7/1973 | Loudas . | |
| 3,761,429 | 9/1973 | Yamano et al. . | |
| 3,813,221 | 5/1974 | Stubits . | |
| 3,816,351 | 6/1974 | Lancz | 510/241 |
| 3,859,225 | 1/1975 | McKnight et al. . | |
| 3,910,855 | 10/1975 | Abeles | 510/425 |
| 3,953,353 | 4/1976 | Barrett, Jr. et al. . | |
| 3,985,502 | 10/1976 | Boorujy et al. | 8/137 |
| 4,095,946 | 6/1978 | Jones et al. | 8/137 |
| 4,097,397 | 6/1978 | Mizutani et al. . | |
| 4,105,592 | 8/1978 | Collins . | |
| 4,105,813 | 8/1978 | Mizuno | 428/76 |
| 4,113,630 | 9/1978 | Hagner et al. . | |
| 4,199,482 | 4/1980 | Renaud et al. . | |
| 4,206,070 | 6/1980 | Jones . | |
| 4,231,744 | 11/1980 | Moot . | |
| 4,336,024 | 6/1982 | Denissenko et al. . | |
| 4,390,466 | 6/1983 | Weinberger . | |
| 4,430,468 | 2/1984 | Schumacher | 524/109 |
| 4,434,090 | 2/1984 | Hampson et al. . | |
| 4,435,346 | 3/1984 | Ito et al. . | |
| 4,490,285 | 12/1984 | Kebanli . | |
| 4,548,954 | 10/1985 | Smith et al. . | |
| 4,563,483 | 1/1986 | Smith et al. . | |
| 4,594,362 | 6/1986 | Smith et al. . | |
| 4,613,646 | 9/1986 | Sandvick . | |
| 4,632,772 | 12/1986 | Garabedian et al. . | |
| 4,670,171 | 6/1987 | Magyar . | |
| 4,680,143 | 7/1987 | Edge et al. . | |
| 4,685,930 | 8/1987 | Kasprzak . | |
| 4,720,351 | 1/1988 | Flynn et al. . | |
| 4,734,221 | 3/1988 | Edwards et al. . | |
| 4,738,791 | 4/1988 | Ertle . | |
| 4,738,792 | 4/1988 | Ertle . | |
| 4,784,800 | 11/1988 | Leng et al. . | |
| 4,834,900 | 5/1989 | Soldanski . | |
| 4,861,516 | 8/1989 | Kurzendoerfer et al. . | |
| 4,880,569 | 11/1989 | Leng et al. . | |
| 4,909,962 | 3/1990 | Clark . | |
| 4,954,286 | 9/1990 | Sepulveda et al. . | |
| 4,992,107 | 2/1991 | Itoku et al. . | |
| 5,205,960 | 4/1993 | Kristopeit et al. . | |
| 5,238,587 | 8/1993 | Smith et al. . | |
| 5,290,472 | 3/1994 | Michael . | |
| 5,411,674 | 5/1995 | Tagata et al. . | |
| 5,415,811 | 5/1995 | Wile et al. . | |
| 5,454,969 | 10/1995 | Fields et al. . | |
| 5,472,455 | 12/1995 | Mehreteab et al. | 8/137 |
| 5,474,713 | 12/1995 | Faber . | |
| 5,492,540 | 2/1996 | Leifheit et al. | 8/111 |
| 5,496,492 | 3/1996 | Hamada et al. . | |
| 5,538,664 | 7/1996 | Michael | 510/217 |
| 5,547,476 | 8/1996 | Siklosi et al. . | |
| 5,559,091 | 9/1996 | Geboes et al. | 510/422 |

FOREIGN PATENT DOCUMENTS

| | | |
|---|---|---|
| 0 429 172 A1 | 5/1991 | European Pat. Off. . |
| 1 536 936 | 12/1978 | United Kingdom . |
| 1 598 911 | 9/1981 | United Kingdom . |
| 2 169 916 | 7/1986 | United Kingdom . |
| WO 91/14038 | 8/1991 | WIPO . |
| WO 95/31523 | 11/1995 | WIPO . |

*Primary Examiner*—Alan Diamond
*Attorney, Agent, or Firm*—Fish & Richardson P.C.

[57] ABSTRACT

Home dry cleaning compositions useful in dry-cleaning of textiles and garments in a non-commercial environment are disclosed. The cleaning compositions useful in conjunction with a a domestic dry cleaning operation the cleaning compositions are contacted with a soiled garment or textile during a tumbling such as is possible with a domestic clothes dryer. The cleaning compositions contain a major proportion of water, and further include minor amounts of a nonionic alkoxylated alcohol, anionic surfactant selected from alkyl sulfosuccinates, alkyl ether sulfosuccinates, alkylamide sulfosuccinates, alkyl sulfosuccinamates, as well as salt forms thereof, organic solvent selected from alcohols and glycol ethers, as well as optional constituents including fluorosurfactants, pH adjusting agents, fragrances, fragrance solubilizers, and preservatives. Processes for domestic dry cleaning utilizing the cleaning compositions, and kits used for practicing a domestic dry cleaning operation utilizing the compositions are also disclosed.

35 Claims, No Drawings

HOME DRY CLEANING COMPOSITIONS

The present invention relates to cleaning compositions which are useful in dry-cleaning of textiles and garments. More particularly the present invention relates to cleaning compositions useful in dry-cleaning of textiles and garments in a non-commercial environment, particularly in a domestic environment.

As is well known to the art, textiles and garments are produced from a variety of different and distinctive fibers such as naturally produced fibers including cotton, wool, silk, as well as synthetically produced fibers including spun polymeric fibers. These fibers may be used individually, but are also encountered in blends of two or more differing types of fibers. The ultimate textile material used as is used in the production of a garment, thus features desirable characteristics of silicate fiber and/or fiber blend.

Typically garments produced from such textile materials ultimately become stained due to normal wear and tear associated with the use of a garment. Generally, one of two techniques may be used in order to remove the stains from such a garment and these include laundry operations as well as dry cleaning operations. The former requires that the garment be totally immersed in a washing medium, typically an aqueous wash bath which includes an effective amount of a detergent agent. However, such a laundering operation is not suitable for many types of textiles and/or garments produced therefrom and such a laundering technique may undesirably deform, discolor or otherwise change the appearance and/or form of the textile and/or garment. In such cases, a dry cleaning technique is generally utilized and such a technique typically one or more organic solvents such as trichloroethylene or perchloroethylene is used as a cleaning medium. Such organic solvents are selected as they are known to have good stain removing characteristics as well as typically possessing a high evaporation rate (or conversely a low boiling point) such that they readily volatilize after their application.

One of the disadvantages of such a dry cleaning process as presently known is that generally a consumer wishing for garments to be cleaned in accordance to a dry cleaning process must have this operation performed by a commercial establishment. This is due in large part to the fact that such known useful organic solvents having such high volatility are inappropriate for use in the home as they tend to release vapors which are deleterious to human health. Such commercial cleaning establishments are suited for the performance of such typical dry cleaning operations as they may exert a very strict control over the solvents used in the process as well as having means for recovering such volatilized solvents from the ambient prior to their release to the environment. Such a release would be very undesirable from ecological considerations.

While such cleaning establishments are well known and are generally numerous, consumers nonetheless generally find the necessity of taking their garments needing dry cleaning to such an establishment an inconvenience due to several factors. This includes the necessity of transporting said garments to and from such an establishment, the necessity of the lag time associated with the cleaning process which can be from several hours to several days. Another concern which is often harbored by consumers is the knowledge that such a commercial dry cleaning establishment recycles the solvent, that the consumers personal garments risk the infestation by entrained microbes, such as bacteria fungi and viruses which may be entrained in such a recycled solvent.

Also, the mere portage of garments requiring dry cleaning to such a commercial dry cleaning establishment is also a source of personal inconvenience.

Various processes also for the individualized dry cleaning of garments in a domestic, i.e., home setting, have also been proposed in the art.

U.S. Pat. No. 3,432,253 is directed to a fabric cleaning process wherein a textile material, particularly draperies, and other fabrics made of glass cloth which are known to be bulky and difficult to clean are placed into a flexible bag made of a material substantially impervious to air leakage. To this bag may then be added a liquid cleaning agent which has been impregnated onto a dry carrier vehicle such as fine saw dust or ground wood. The thus impregnated carrier vehicle functions as the active cleaning agent in the subsequent dry cleaning operation acting to both distribute the cleaning material as well as acting as a contacting/abrasing agent. In operation, the bag is sealed after the introduction of the cleaning agent and a plurality of such loaded bags are then provided to a tumbling machine such as are commonly available and known in commercial use. Such tumbling operation continues for a sufficient period of time until adequate cleaning of the draperies and/or fabrics is achieved after which they may be removed from the individual bags. Then as such a process is in providing individualized cleaning of a single fabric and/or drapery. The bag used in this process is a air impermeable bag, preferably a polyethylene bag which may be hermetically sealed.

U.S. Pat. No. 4,336,024 is directed to a home dry cleaning process and formulations useful in its practice. In such a home dry cleaning process a three step operation is performed. In the first step, the article of clothing, i.e., the garment, is treated with a liquid cleaning agent which comprises at least one or more organic solvents selected from alcoholic solvents, a ketonic solvent, ethers, chlorinated solvents, hydrocarbon solvents or mixtures of two or more of the same, up to 60% by weight water, and optionally but desirably a surface active agent selected from anionic, cationic, amphoteric or nonionic surface active agents. Further optional constituents which may be included include anti-foaming agents, perfumes, anti-static agents, aerosol propellants and/or bactericides which may be added in minor amounts. Subsequent to the treatment step, the article of clothing is then laid flat upon an absorbent sheet; said absorbent sheet may be any wide variety of known porous or fibrous flexible sheets. In the final step, the article of clothing laid upon the said absorbent sheet is then required to be laid flat on the interior circular surface on the drum of a washing machine so that the clothing and sheet may be subjected to the washing machines normal spin cycle. Such an operation requires that the garment and sheet be then retained in a substantially horizontal configuration against the internal wall of the drum of the washing machine and may require a system of clips, slides, tape, straps, or other removable fastening means for the temporary retention of the garment and sheet against the internal wall of the washing machine drum so to enable the cleaning agent to migrate as completely as possible from these treated garment into the absorbent sheet with the conclusion of which the absorbent sheet can be disposed.

Published PCT Patent application WO 91/14038 discusses a process for cleaning and freshening textiles in a drum type drying machine, wherein at least part but preferably all of the interior of the drum surface is covered with an fleece type textile, particulary those which are absorbent to oil and fatts such as synthetic fibers based on polypropylene, polyeters, polyethylene, polyurethane and polytetrafluoroethylene, as well as blended textiles based on those fibers. To assist in the cleaning and freshening of the textiles, the use of washing adjuvants may be used and such may be introduced into the interior of the drum such as by spraying or pouring thereinto; such washing adjuvant may be "commerically available products."

Further U.S. Pat. No. 5,238,587 directed to a dry cleaning kit for in-dryer use is directed to a laundry cleaning sheet which comprises a gelled solvent-based dry cleaning composition for use in the freshening and/or dry cleaning of spotted or stained fabrics such as are encountered in garments. In use, the prepared sheet is introduced with stained garments or other fabric articles in a containment bag after which the bag is sealed and tumbled in a conventional clothes dryer at a temperature which is effective to release and/or volatilize the active constituents of the sheet and to thus effect a cleaning operation to the garment or other textile article. Afterwards, the bag is removed from the dryer, unsealed and the garments and/or textile articles removed.

Published European Patent application, EP 0429172 A describes a domestic dry cleaning processes which utilizes an air impermeable bag for receiving garments or other fabric articles after which the bag is sealed and tumbled in a conventional clothes dryer, as well as amounts of a cleaning formulation. Therein are disclosed cleaning formulations which are provided as impregnated into a carrier which may be a fine sawdust or a flexible sheet, and preferred for use are non-aqueous dry cleaning solvents, most preferably terpenes, pinenes and volatile silicones. Also introduced into the bag are certain cleaning formulations. Specifically recited technical benefits which are achieved by the recited process include the imparting of a "fresh scent" as well as improved softness to articles which have been treated with volatile silicones.

GB Patent 1598911 teaches in its specification an alternative method for effectuating a home dry cleaning operation wherin a spotted or stained fabric or garment article are introduced into a first vapor permeable bag and sealed therein, and then the first bag is introduced into the interior of a second liquid impermeable bag which contains a dry cleaning solvent, which is also sealed. Subsequently the bags are tumbled in a washing or drying appliance for a sufficient time such that the solvent is vaporized and passes into the first bag and the garment article of fabric contained therein.

While these prior art documents illustrate various alternative approaches to providing techniques for dry cleaning of garments in a domestic environment, each of these techniques is not without its shortcomings and limitations, which limitations are addressed and overcome by the present applicants' invention.

It is therefore among the objects of the invention to provide an improved dry cleaning formulation which may be used in a domestic or home dry cleaning operation.

It is a further object of the invention to provide improvements to dry cleaning formulations which formulations feature good efficacy yet simultaneously feature surprisingly low amounts of volatile organic solvents; such new and improved formulations are particularly suited to be used in a domestic dry cleaning operation as they feature low amounts of volatilizable solvents.

It is another object of the invention to provide a process for dry cleaning garments in a domestic environment.

It is yet another object of the invention to provide a home dry cleaning kit which comprises a containment bag in conjunction with the new and improved formulations according to the present invention.

It is yet another object of the invention to provide a home dry cleaning kit which comprises a containment bag in conjunction with the new and improved formulations which may be provided in a carrier device which are suitable for use in the practice of a dry cleaning process in a domestic environment.

Also, the present invention includes among its objects improved processes for the dry cleaning in a domestic environment particularly dry cleaning in a clothes dryer which process includes the step of applying the new and improved formulations to the soiled textile and/or garment and subsequently tumbling said treated textile and/or garment which are contained in a sealable containment bag in a dryer apparatus.

According to an aspect of the present invention, there is provided a dry cleaning composition which is particularly useful in a domestic dry cleaning operation which comprises a liquid cleaning composition which comprises;

0.01–5% nonionic surfactant, 0.01–2.5% anionic surfacant selected from alkyl sulfosuccinates, alkyl ether sulfosuccinates, alkylamide sulfosuccinates, alkyl sulfosuccinamates, as well as salt forms thereof, 0–1% fluorosurfactant, 0.01–7% organic solvent selected from alcohols and glycol ethers, to 100% water wherein the percentages indicated are representative of parts by weight based on the total weight of the cleaning composition.

The cleaning compositions may also include one or more optional constituents in minor amounts including for example, pH adjusting agents including acids and bases, particularly buffer compositions, fragrances and fragrance adjuvants including fragrance solubilizers, preservatives, as well as others not listed here. Such further optional constituents are typically present in only minor amounts, generally they in total comprise no more than about 2% by weight of the total cleaning compositions being taught herein, and typically in total are present in the present inventive compositions in amounts of about 1% and less by weight.

The liquid cleaning compositions according to the present invention which are suited for use a home dry cleaning compositions include specific amounts of one or more nonionic surfactants, of which are preferred water soluble nonionic alkoxylated alcohols and alkoxylated phenols many of which are known to the art and available in nonionic surfactant preparations. Such nonionic surfactants are known to the art, and include one or more alkoxylated phenols, such as ethoxylated phenols, as well as ethoxylated and/or propoxylated alcohols formed by condensation of either an alkyl phenol or an aliphatic alcohol with sufficient ethylene oxide and/or propylene. Such ethoxylated alcohols, propoxylated alchohols and ethoxylated phenols, are well known and may be formed by condensation of an alkyl phenol, an aliphatic alcohol, or mixtures thereof, with sufficient ethylene oxide to produce a compound having a polyoxyethylene. Preferably the number of ethylene oxide units are present in an amount sufficient to insure solubility of the compound in an aqueous composition of this invention or in any dilution thereof. More preferably the ethoxylated alcohols and phenols are produced by condensation of about 4–16 (more preferably 8–13), moles of ethylene oxide with 1 mole of the parent compound (i.e. alkyl phenol or aliphatic alcohol). As known to those skilled in the art, the number of moles of ethylene oxide which are condensed with one mole of parent compound depends upon the molecular weight of the hydrophobic portion of the condensation product. The parent compounds that may be combined with the ethylene oxide may include one or more of the following:

(A) an alkyl phenol having about 1–15, and preferably 7–10, carbon atoms (saturated or unsaturated) in the alkyl group [including phenol, methyl phenol (cresol), ethyl phenol, hexyl phenol, octyl phenol, dicylphenol, nonylphenol, dodecylphenol, and the like]; and (B) a primary, tertiary, or secondary aliphatic alcohol having about 10–20, and preferably 11–15, carbon atoms, (including decyl alcohol, dodecyl alcohol, tridecyl alcohol, hexadecyl alcohol, octadecyl alcohol, and the like).

Illustrative examples of these preferred water soluble nonionic ethoxylated phenols and/or ethoxylated alcohols surfactants include one or more of those available under the tradename of NEODOL, presently commercially available from the Shell Oil Company; TERGITOL, presently commercially available from Union Carbide, and POLYTERGENT, presently commercially available from the Olin Chemical Co., and IGEPAL presently commercially available from the Rhone-Poulenc Co. Specific examples of such useful nonionic surfactants include NEODOL 25-3, which is believed to be a linear $C_{12}$–$C_{15}$ linear primary alcohol condensed with 3 moles of ethylene oxide per mole of alcohol; NEODOL 25-7, which is believed to be a linear $C_{12}$–$C_{15}$ linear primary alcohol condensed with 7 moles of ethylene oxide per mole of alcohol; NEODOL 25-9, which is believed to be a linear $C_{12}$–$C_{15}$ linear primary alcohol condensed with 9 moles of ethylene oxide per mole of alcohol; NEODOL 25-12, which is believed to be a linear $C_{12}$–$C_{15}$ linear primary alcohol condensed with 12 moles of ethylene oxide per mole of alcohol; TERGITOL 15-S-7, believed to be a random secondary $C_{11}$–$C_{15}$ alcohol condensed with 7 moles of ethylene oxide per mole of alcohol; TERGITOL 15-S-9, believed to be an alkoxypolyethylenoxyethanol which may be represented by the formula $C_{11-15}H_{23-31}O(CH_2CH_2O)_2H$ having a degree of ethoxylation on a mole/mole average of 8.9, POLYTERGENT SL-22, believed to be an alkoxylated linear aliphatic alcohol; POLYTERGENT SL-62, also believed to be an alkoxylated linear aliphatic alcohol, as well as mixtures thereof Exemplary alkoxylated alkyl phenols include those presently commercially available under the trade name IGEPAL, and which are described to be octyl and nonyl phenols. Specific compositions include: IGEPAL CA-210 which is described as an ethoxylated octyl phenol having an average of 1.5 ethoxy groups groups per molecule, and IGEPAL CA-420 which is described as an ethoxylated octyl phenol having an average of 3 ethoxy groups groups per molecule.

Further useful nonionic surfactant compositions which may be used include those presently commerically available under the trade name SURFYNOL from Air Products & Chemicals, Inc. and which includes a variety acetylinic diols and acetylinic diols, as well as others. Of this series of products, SURFYNOL 61 which is described as being dimethyl hexanol, SURFYNOL 104 descrbed to be tetramethyl decynediol, and SURFYNOL 104A described to be tetramethyl decynediol dissolved in 2-ethylhexanol are very advantageouly used.

Preferably, the nonionic surfactant constituent is an alkoxylated alcohol constituent which even more preferably is one or more ethoxylated primary or secondary alcohols surfactant compositions.

The nonionic surfactant compositions, and in particular the preferred nonionic alkoxylated alcohol constituents are included in the home dry cleaning compositions in an amount ranging from about 0.01 to about 5.0 weight percent, based on the total weight of the home dry cleaning compositions composition. Most preferably, the nonionic surfactant composition is employed in an amount ranging from 0.05 to about 1.0 weight percent, and most preferably, from 0.1 to 0.15 weight percent.

The compositions according to the invention include an anionic surfactant constituent which is selected from alkyl sulfosuccinates, alkyl ether sulfosuccinates, alkylamide sulfosuccinates, alkyl sulfosuccinamates, as well as salt forms thereof. Generally, the alkyl or acyl radical in these various compounds comprise a carbon chain containing 12 to 20 carbon atoms. Many such anionic surfactants are known to the art and are available from a variety of sources, including materials presently commercially available under the tradename ALKASURF (Rhône-Poulenc Co., Princeton N.J.) as well as those presently commerically available under the tradename MONAWET (Mona Industries, Paterson N.J.). By way of illustrative example, these include the following: ALKASURF SS-MA-80, which is described to be a sodium dihexyl sulfosuccinate, ALKASURF SS-NO, which is described to be tetrasodium N-alkyl sulfosuccinamate, ALKASURF SS-O, which is described to be sodium dioctyl sulfosuccinate, ALKASURF SS-OA-HE described to be a disodium oleyl amido polyethyleneglycol-2 sulfosuccinate, ALKASURF SS-TA, disclosed as being sodium N-octadecyl sulfosuccinamate, ALKASURF SS-L7DE, which is described as being a sodium sulfosuccinate ester of lauric diethanolamide, ALKASURF SS-L9ME, which is described as being a sodium sulfosuccinate ester of lauric monoethanolamide, ALKASURF SS-L-HE, which is disclosed to be sodium di-isobutyl sulfosuccinate, MONAWET MB-45, described to be diisobutyl sodium sulfosuccinate, MONAWET MM-80, described to be dihexyl sodium sulfosuccinate, MONAWET MO-65-150, which is described to be dioctyl sodium sulfosuccinate, MONAWET MO-70 and MONAWET MO-80, both disclosed to be dioctyl sodium sulfosuccinate, MONAWET MT, described to be di-tridecyl sodium sulfosuccinate, MONAWET SNO-35, described to be a tetrasodium salt of N-(1,2,dicarboxyethyl)N-octadecyl sulfosuccinimate, as well as MONAWET TD-30, described to be an ethoxylated fatty alcohol, half ester of sulfosuccinate acid.

Generally, this anionic surfactant constituent is a single surfactant, or is a mixture of such surfactants, and which is included in the home dry cleaning compositions in an amount ranging from about 0.01 to about 2.5 weight percent, based on the total weight of the home dry cleaning compositions composition. Most preferably, the anionic surfactant constituent is employed in an amount ranging from 0.01 to about 2.0 weight percent, and most preferably, from 0.01 to 1.0 weight percent.

Optionally but in some cases desirably the liquid home dry compositions according to the invention include a fluorosurfactant constituent. Desirably the inclusion of such a fluorosurfactant constituent improves the wetting of the garments or textiles being treated so to improve the penetration of the liquid home dry compositions. Any of a number of known fluorosurfactant compositions may be used, and desirably those which are low foaming are preferred. Such useful fluorosurfactant compositions are generally contain at least one fluoro-moiety. Of course, mixtures of two or more florosurfacants may be used.

Many useful fluorosurfactant constitutents as known to the art. By way of non-limiting example these include fluorinated and perfluorinated alkyl carboxylates, fluorinated and perfluorinated alkyl alkoxylates, fluorinated alkyl esters, perfluorinated alkyl sulfonates, fluorinated and perfluorinated alkyl quarternary ammonium iodides, fluorinated alkyl polyoxyethyelene alcohols, as well as salt forms thereof, especially ammonium, alkali and alkaline earth metal salts.

An exemplary useful fluorosurfactant is that presently commercially available under the tradename FLUORAD which includes among other materials various perfluoroalkyl sulfonates, perfluoroalkyl carboxylates and well as salts thereof, and fluorinated alkyl esters. One such material is FC 170C (3M Company, Minneapolis Minn.), which is described as a being a fluorinated alkyl polyoxyethylene ethanol. This material.

Further useful fluorosurfactants include those presently commercially available under the tradename ZONYL (E. I. DuPont De Nemours & Co., Wilmington Del.).

When present the fluorosurfactant constituent is present in an amount of up to about 1% by weight, but is desirably present in only minor amounts generally in an amount of up to about 0.01% by weight and even less. Typically, the fluorosurfactant composition has been found to be effective in dilutions of from 1–5000 ppm (parts per million) based on the total weight of the liquid home dry compositions, and amount of from about 100–2500 ppm have been found to be effective.

The compositions according to the invention include an organic solvent constituent which is selected from water soluble alcohols and or glycol ethers. Exemplary water soluble alcohols are desirably a lower alkyl monohydric alcohol including but not limited to straight chained and branched $C_{1-6}$ alcohols which are preferred. Such alcohols, per se, are known to the art and are widely commercially available. Any water soluble alcohol, particularly the preferred $C_{1-6}$ alcohols may be used and incorporated into the home dry cleaning compositions being taught herein and are desirably selected so to exhibit good aqueous solubility, efficacy as a solvent for the removal of certain stains, and particularly desirably to be volatile so that once applied to the soiled garment or textile, readily volatilize therefrom.

The organic solvent constituent of the home dry cleaning compositions taught herein may also be a glycol ether solvent constituent. Preferred as the glycol ether solvent constituent according to the present invention are water soluble glycol ethers according to the general structure $R_a$—O—$R_b$—Oh, wherein $R_a$ is an alkoxy of 1 to 20 carbon atoms, or aryloxy of at least 6 carbon atoms, and $R_b$ is an ether condensate such as of a propylene glycol and/or ethylene glycol having from one to ten glycol monomer units. Preferred are $C_3$-$C_{20}$ glycol ethers are those having one to five glycol monomer units. Further examples of particularly preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Exemplary glycol ethers which may be very advantageously employed as the solvent constituent is one or more of the solvents of the group consisting of diethylene glycol methyl ether, ethylene glycol n-butyl ether, diethylene glycol n-butyl ether, ethylene glycol hexyl ether, diethylene glycol hexyl ether, and mixtures thereof. These materials are presently commercially available under the tradename DOWANOL from the Dow Chemical Co. (Midland MI); ARCOSOLV from the Atlantic Richfield Co., as well as CARBITOL or CELLOSOLVE, both from Union Carbide Corp. (Danbury Conn.).

The organic solvent constituent may be one or more water soluble alcohols, one or more glycol ether solvent constituents, or mixtures of one or more alcohols and one or more glycol ethers. The organic solvent constituent is generally included in the home dry cleaning compositions in an amount ranging from about 0.01 to about 7 weight percent, based on the total weight of the home dry cleaning compositions being taught herein. However, the alcohol constituent is desirably included in lower proportions, and preferably it is utilized in an amount ranging from about 0.05 to about 5 weight percent, and most preferably, from 1.0 to 5.0 weight percent.

Where the organic solvent constituent includes one or more glycol ether solvent constituent is preferably employed in an amount sufficient to sufficiently solubilize the home dry cleaning compositions composition so that it is not overly viscous or gellatious in nature, but rather, exhibits a flow viscosity similar to lower alkyl alcohols or water. Generally the likelihood of forming a composition which has such a viscous or gellatious is minor due to the fact that a substantial proportion of the composition is water, however such a likelihood is possible and is desirably to be avoided, as lower viscosity characteristics are particularly beneficial when the home dry cleaning compositions composition is provided in a package or dispenser which includes a dispensing pump or nozzle. Also, lower viscosity characteristics facilitate the absorption of the home dry cleaning composition amongst the fibers of a textile or garment. The desired low viscosity characteristic may be achieved in part by the careful selection of one or more glycol ether solvents with particular attention to their solubility characteristics in water, as well as their molecular weights. For example, a formulation within the present invention's scope may have it viscosity lowered by the inclusion of a greater amount of a lower molecular weight glycol ether solvent. At the same time, care should be taken in the selection of the glycol ether solvents so ensure that good stain solubilization properties, including those normally associated with higher molecular weight glycol ethers by desirably ensuring that they are included in the home dry cleaning compositions as well. Thus, with a view to these considerations the selection of a good glycol ether solvent constituent may be made experimental evaluation techniques familiar to those skilled in the art.

As is noted above, the compositions according to the invention are aqueous in nature, as water forms the major constituent. The water used in the production of the inventive compositions may be tap water, but is preferably distilled and is most preferably deionized water. If the water is tap water, it is preferably substantially free of any undesirable impurities such as organics or inorganics, especially minerals salts which are present in hard water which may detract from the operation of the one or more of the essential constituents according to the invention, as well as any other optional components which may be included. Water is added to in sufficient amounts so to provide 100% by weight of the cleaning composition. Desirably, the water forms at least about 90% by weight, and more desirably at least about 92% by weight of the total weight of the home dry cleaning compositions being taught herein.

As has been denoted above, the home dry cleaning compositions according to the invention may comprise one or more of the following optional components, the total weight of such optional constituents not exceeding about 2% by weight of the total weight of the composition, more preferably not exceeding about 1% by weight and is most preferably less than about 1% by weight based on the total weight of the composition. Such optional constituents may be one or more of the following: coloring agents, fragrances (whether natural or synthetically produced), fragrance adjuvants and/or fragrance solubilizers, viscosity modifying agents, thickeners, gelling agents, optical brightening agents, pH adjusting agents such as acids or bases and especially pH buffers, water softening agents, biocides and preservatives. By way of example but not by way of limitation, commerically available compositions useful as preservatives for the home dry cleaning compositions being taught herein include those marketed under the tradenames KATHON (Rohm & Haas Co., Philadelphia Pa.), DOWICIL (Dow Chemical Co., Midland Mich.), BUSAN (Buckman Laboratories, Memphis Tenn.) and DANTOGARD (Lonza Chemical Co., Fairlawn N.J.).

Such constituents as described above, including the nonionic surfactants, anionic surfactants, flurosurfactants and solvents, as well as optional constituents including those recited above are well known to the art, and are preferably selected so as not to detract from the other advantageous features of the inventive compositions. Such materials are described, for example in *McCutcheon's Detergents and Emulsifiers,* Vol. 1, North American Edition, 1991; as well as in in *McCutcheon's Functional Materials,* Vol. 2, North American Edition, 1991, the contents of which are herein incorporated by reference.

The present inventive compositions have surprisingly been found by the inventors to be excellent cleaners to perform well as a cleaning composition for use in a domestic dry cleaning process as is to be described in more detail below. This is particularly surprising as water is found to be a major constituent of the composition, and that only minor amount of surfactants and other solvents are present, yet good dry cleaning effects have been observed. The present inventive compositions have also been found by the inventors to leave little, but generally no residues or residual marks on treated garments; residues or rings which have been known to the art and are typically attributed to the surfactants contained in such prior art compositions. The present inventive compositions have also been found to be good general cleaning compositions on a wide variety of textiles, such as wool, cotton, synthetic fibers such as rayon, and silk which is particularly difficult to dry clean.

In accordance with a particularly preferred embodiment of the invention, there is provided home dry cleaning composition consisting essentially of the following constituents:

0.01–2.5% wt. nonionic alkoxylated alcohol, 0.01–2.5% wt. anionic surfactant selected from alkyl sulfosuccinates, alkyl ether sulfosuccinates, alkylamide sulfosuccinates, alkyl sulfosuccinamates, as well as salt forms thereof, 0–0.1% wt. fluorosurfactant, 0.01–7% wt. organic solvent selected from alcohols and glycol ethers, 0–1% wt. optional constituents, to 100% wt. water.

By way of nonlimiting example, such optional constituents include one or more selected from pH adjusting agents such as buffers and acids or bases, fragrances, fragrance adjuvants and solubilizers, preservatives, coloring agents, and optical brighteners.

The present inventive compositions may be simply produced as by mixing measured amounts of individual constituents to form a homogenous mixture therefrom. This may be done by well known techniques, and is desirably done in a simple paddle mixer, stirrer or other low shear liquid mixing apparatus so to avoid undesired foaming of the compositions.

In accordance with one aspect of the process according to the invention, a soiled garment is treated by applying an effective amount of the cleaning composition directly to the surface of the garment. This can be done in one or more of the following ways and such an application can take place in a number of forms and using a number of devices. For example, in accordance with one embodiment of the invention, the cleaning composition is provided to the consumer in a conventional dispenser such as a spray bottle, squeeze bottle, aerosol, or other dispensing container. In such a way, application of the cleaning composition is possible by the requisite pumping of the spray bottle, alternately squeezing and dispensing the cleaning composition from the squeeze bottle or in a further alternative by spraying from the pressurized aerosol container the cleaning composition. After an effective amount of the cleaning composition has been applied to the surface of one or more garments to be treated, the treated garment is then introduced into the interior of a containment bag. The garment may be introduced singly or can be in conjunction with other articles to which the cleaning composition has been applied in a similar fashion, or in conjunction with other articles which have not been contacted with the cleaning composition according to the invention. Subsequently, the containment bag is sealed so to retain the one or more articles wherein, and then the sealed contaiment bag with its contents are introduced into the interior of a domestic dryer apparatus. Various constructions for the sealable containment bag are described in more particular detail below.

Optionally, localized stains may be cleaned separately by the consumer using a spot cleaning composition prior to the application of the liquid cleaning compositions being taught herein. Such spot cleaning compositions include those known to the art, and further includes the spot cleaning compositions described in co-pending U.S. patent application Ser. No. 08/666,690, the contents are wholly incorporated herein by reference thereto. Therein is described an aqueous spot cleaning composition which comprises the following constituents: 0.1–10% wt. nonionic alkoxylated alcohol; 0.1–10% wt. nonionic alkoxylated mono- and di-alkanol amide; 0.1–3.5% wt. anionic surfactant especially one or more selected from alkyl sulfosuccinates, alkyl ether sulfosuccinates, alkylamide sulfosuccinates, alkyl sulfosuccinamates, as well as salt forms thereof; 0–1% wt. flurosurfactant; 0.01–7% wt. alcohol solvent especially water miscible alcohols; 0.01–30% wt. glycol ether solvent, especially water miscible glycol ethers; to 100% wt. water. Optionally, these spot cleaning compositions may include up to about 2% wt. of one or more conventional additives such as acids, bases, pH buffers, coloring agents, fragrances and the like. Desirably, these spot cleaning compositions comprise at least about 70% wt. water.

A spot cleaning composition may be advantageously employed to clean hard to remove as well as localized stains on the garment to be treated.

Typically in accordance with the processes according to the invention, dryer apparatus including those having a rotating drum which rotates about a horizontal axis, but in some cases includes a drum which rotates about a vertical or other non-horizontal axis and such may be also used. Generally, those having a drum which rotates about an approximately horizontal axis are preferred. Such horizontally rotating drum ensures a good tumbling effect to the articles within the sealed containment bag and aids in the effective and uniform distribution of the cleaning composition amongst the surfaces of the garments being treated.

Subsequent to its introduction of the sealed containment bag into the dryer apparatus, the dryer apparatus is actuated and optionally, heated for sufficient time to allow the tumbling of the treated garment and to distribute the cleaning composition onto the garment or textiles being treated. As an alternative process and dependent upon the available modes of operation of the dryer apparatus, after the introduction of the sealed containment bag containing the garments to be treated, the rotating drum is actuated to operate for several minutes without the application of heat to the rotating drum which permits tumbling of the containment bag and the distribution of the cleaning compositions of the instant invention more uniformly to the garments within the sealed containment bag prior to the appreciable volatilization of the cleaning compositions. Subsequent to this process step, the dryer apparatus may then be actuated to apply heat to the rotating drum and its contents so to volatilize at least a major portion of the cleaning composition. Subsequently, the treated garments may be removed and are optionally subjected to further treatment steps such as ironing, pressing and the like. The treated garments or textiles are typically damp to the touch following this treatment step.

If desired, the thus treated garments and textiles may be treated with a fabric treatment composition such as a sprayable fabric softening composition, or an antistatic composition.

The liquid cleaning compositions being taught herein are advantageously used in a process for home dry cleaning wherein one or more garments or textiles are provided into the interior of a containment bag with a quantity of the compositions, the bag is then closed and inserted into a clothes dryer and the containment bag and its contents are tumbled to ensure the distribution of the liquid cleaning composition to the garments or textiles. The dryer dry cleaning and freshening system shown in FIG. 1 includes a containment bag having an opening conveniently placed at one side thereof. With reference to containment bag it may be fabricated of a material which is vapor impermeable material such as a plastic or polymer material such as from a sheet or film which is sewn, as well as certain non-woven textiles and formed materials, such as TYVEK (DuPont Corp., Wilmington Del.) and the like. Such a containment bag is typically sealed or otherwise fastened on one or more edges in order to form said containment bag, and any conventional means for its production may be used. Such sealing or fastening means include for example sewing, welding, melt-bonding as well as other conventionally known means. It is further to be understood that while a vapor impermeable material may be used in the construction of the containment bag, it is to be understood that such a bag itself need not be totally hermetically sealable itself and that the escape of vapors or gases from within such a containment bag to its exterior, such as the interior space of a clothes dryer is to be foreseen. Such an escape of vapors may occur at seams of said containment bag, particularly where sewn seams are present, as well as from the sealable opening. Alternately, the containment bag may be fabricated of a material which is vapor permeable, such as a woven or non-woven textile material, which may be made of naturally occurring or synthetically produced fibers, as well as blends of two or more different materials. Both the vapor permeable materials and the non-vapor permeable materials may be a single layer material, or may be of a multilayer construction such as two or more layers of differing materials layered in register. Examples of such include a first layer of a non-woven material which is used in the innermost layers of the containment bag, which is in turn layered with a non-woven material such as a polymer film layer which desirably provides a vapor impermeable barrier layer to the containment bag. A second example of multilayer containment bag construction includes a first innermost layer which is a fibrous material, such as a non-woven material and a second layer in register therewith of a non-woven vapor impermeable synthetic paper-like material such as TYVEK material which is used to form the exterior of the containment bag. Such a construction provides the advantage of providing a vapor impermeable containment bag, which has a durable exterior layer which in turn increases the operating life of such a containment bag. Further, the exterior material made of TYVEK or a similar material is readily printable using known art techniques which permits the printing of a legend, logo or instructions for use on this exterior surface of the containment bag. A third preferred material of construction useful in the fabrication of a containment bag is a two or three layered construction, wherein the first and innermost layer of the containment bag is of a non-woven, fibrous material such as of a synthetically produced fiber, which in turn in bonded to a second spun bonded polymeric textile material, which imparts strength to such a containment bag construction. Optionally, but desirably a third layer of a non-woven, fibrous material is bonded to the remaining side of the spun bonded polymeric textile material and thus forms the exterior of the containment bag. The fibrous material used in the formation of this third layer may be of the same synthetically produced fiber of the first, innermost layer or it may be of a different fiber.

A further and most preferred material of construction for the fabrication of the containment bag is a vapor impermeable or poorly vapor permeable bilayered material which has on its first layer a polymeric film, which is bonded to a second layer of a polymeric spun bonded nonwoven textile material. Both the polymeric film and the polymeric spun bonded nonwoven textile material may be produced from a variety of known art polymers and copolymers including for example nylons, polyalkylene terephthalates, rayon, as well as polyalkylenes especially polyethylene, polypropylene and polybutylene being of particular advantage due to their low cost and ready fabrication into both vapor impermeable films as wall as nonwoven textile materials. The bonding between these layers may be accomplished by virtually any known means, including for example heat bonding, resin bonding which may require the use of a bonding material or film intermediate to the first film layer and second film layers, as well as ultrasonic bonding methods which provide effective binding between these two materials and which may be practiced to produce an attractive dimpled appearance on the final material. In accordance with this most preferred embodiment, the containment bag is constructed such that the first film layer is forms the interior of the containment bag and thereby, and the second film layer forms the exterior of the containment bag. A first advantage of this most preferred containment bag construction is that the interior film layer of the bag is both vapor impermeable and is nonabsorbent of the liquid cleaning composition and thus the maximum cleaning efficacy of these compositions is available to the clothes or other textiles being treated in the process according to the invention. A second advantage of the preferred construction is the inventors' observation that such a containment bag billows sufficiently during the tumbling and heating it encounters in the dryer apparatus, yet permits the escape of vapors produced or entrapped within the containment bag to escape at an acceptable rate.

A third advantage enjoyed by the preferred construction is the durability of such a containment bag as the nonwoven film layer which forms the exterior of the bag is resistant to tearing, and at the same time the soft tactile characteristics of this layer make the bag especially attractive from the standpoint of the consumer.

Other advantageous materials of construction for the fabrication of containment bags 1 which are alternative especially preferred embodiments having a vapor impermeable or poorly vapor permeable bilayered material which has on its first layer a polymeric film, which is bonded to a second layer of a textile material include for example: a first vapor impermeable layer of a copolymer film for a film formed from a blend of polymers including for example: polyethylene terephthalate—polybutylene terephthalate; polyethylene terephtalate—rayon which are in turn bonded to second layer of a polymeric nonwoven textile material which may be for example: rayon, and spun bonded or melt blown polyethylene or polypropylene textile materials. Such materials of construction useful for the fabrication of containment bags 1 which may be produced from these immediately above recited include: a first layer of a polyalkylene film, such as polyethylene or polypropylene bonded to a second layer of a textile material based on a blend of rayon and polyethylene terephthalte; and, a first layer of a polyalkylene terephalate film, bonded to a second layer of a rayon textile material.

It is to be understood that in any of the constructions recited which include one or more polymeric materials, that minor amounts of conventional additives may be included in conventional amounts including but not limited to: colorants, heat stabilizers, ultraviolet stabilizers and filler materials. Such are, per se, known to the art.

Both the first layers and the second layers may be of the same or different thicknesses, and it is required only that the containment bag formed from these materials be flexible. Most desirably however, the thicknesses of both the first and second layer are less than about 20 mils, more desirably the thickness of the first, preferably vapor impermeable layer is 5 mils and less, especially 3 mils and less, while the thickness of the second layer and any further layer is about 5 mils and less.

The dimensions of the containment bag and its internal volume may vary considerably. Desirably however, the containment bag is sufficiently large to contain at least one garment or textile to be treated, but preferably 2–3 such garments, as well as the absorber means being taught herein, while at the same time not be overly large and thus be inconvenient for use in a domestic dryer apparatus. Advantageously the containment bag has a volume of about 75 liters or less, with sizes of about 50 liters, and about 30 liters being preferred.

The opening of the containment bag is conveniently located at an edge of the containment bag, but it may be located elsewhere. The opening may be a simple slit or discontinuity in the material of the bag's construction or it may take a more complex form such as further including a foldable flap to close the bag, or may also use fastening means. Suitable fastening means may be any useful fastening means known to the art including, but not limited to one or more of the following: zippers, hook-and-loop type fasteners (VELCRO®), buttons, clips, pins, snaps, adhesive strips, as well as resealable plastic sealing elements such as two strips, one on each margin of the opening when pressed together interlock to form a flexible seal. Such resealable plastic sealing elements are known to the art dealing with plastic bags and pouches, and are sometime referred to as ZIP-LOCK® type closures. Suitable fastening means also includes the use of a simple drawstring to pull the opening shut, the use of a single deformable wire-type "twist tie" to close the opening, as well as the use of one or more fastening means in conjunction with a flap. Further conventionally known fastening means although not elucidated here may also be used. In accordance with the convenient placement of the opening at or near an edge of the containment bag, the fastening means is placed at or about the edge of the bag as illustrated on FIG. 1. It is only required that the selected fastening means be affixable onto the materials of construction used to fabricate the containment bag, and that it form a relatively secure closure. Desirably, the containment bag is closeable to provide a liquid seal to minimize the leakage of any liquid cleaning composition out of said bag and into the dryer, which in turn ensures that maximum cleaning effect is imparted to garments or other textile materials being treated.

In a containment bag construction, the use of a fibrous material to form the innermost surface of the containment bag may be desired as such a fibrous material is suited to entrap and entrain particles which may be released from a garment or textile being cleaned and/or absorbing of the cleaning composition being provided herein. Such a containment bag may be desired as they may be amenable to laundering by the consumer. Following such a laundering operation, the entrained/entrapped particulates, soils, as well as any residual cleaning composition may be removed from the containment bag and as such, the bag may be reused in a further dry cleaning operation.

One alternative embodiment of the process according to the instant invention, the cleaning compositions are used in conjunction with a dispensing container, or other container, which contains the cleaning composition as well as an absorbent sheet. Such absorbent sheets may be produced from any fibrous or cellular flexible material which exhibits sufficient thermal stability for use in a clothes dryer. For example, such sheets may be non-woven materials such as those which have bonded fibers in a web accorded fiber structure and/or those which comprise fibrous mats in which the fibers are distributed in a random array. Such a fibrous can be naturally produced fibers including wool, silk, cotton, linen, hemp, sisal, ramie or may be synthetically produced such as synthetically spun fibers of polymers. Examples of such synthetic fibers include rayon, cellulose, polyvinyl derivatives, polyolefins, polyesters, as well as polyamides. Of course, mixtures of two or more different fibers may be used in the production of such non-woven materials. Preferably such sheets are sufficiently strong such that they will resist tearing or separation when used in a clothes dryer as described in the processes taught herein. These sheets, when used, may be of any dimension but are preferably sheets having an area of at least one square centimeter and greater. Sheets having larger areas, i.e., those having areas of at least 50 square centimeters and greater are preferred from the view point of ease of use and handling. Such larger sheets are generally preferred as subsequent to the home dry cleaning processes being taught herein. They may be readily separated from the treated garment and easily discarded. From this perspective then it is clear that an overly large sheet such that which would resist the tumbling operation of the garments being treated and/or would tend to clump or bundle during the tumbling operation of the clothes dryer are to be desirably avoided. As a function of the sheet is to act as an absorbent substrate for the cleaning composition and/or to act as a transport vehicle wherein cleaning composition absorbed upon the surface of the sheet may tumble and ultimately recontact a different region of the garment or textile material to be treated. In view of the foregoing then it is preferable that an intermediate size sheet and/or a plurality of intermediate sheets, preferably those having an area of at least about 50 square centimeters are to be used.

In accordance with a further aspect of the invention, there is provided a system optionally in kit form which includes a containment bag as described above, a quantity the liquid cleaning composition as taught herein, and a dispenser means. Such a dispenser means may be a ball-shaped dispenser which may be separated into hemispheres and which includes in one of the hemispheres a vessel for the containment of the cleaning composition taught herein in a measured amount. The vessel also includes a fluid communication means such as one or more perforations, preferably small perforations and/or a semi-permeable wall or sealing cap which permits for the flow of the cleaning composition from the interior of the vessel to the exterior of the dispenser such that it may be contacted with a garment or textile. The advantage of such a dispenser is that it may be produced as both a single use dispenser and disposed after a single dry cleaning operation or it may be produced as a refillable and multi-use dispenser wherein the consumer may refill the dispenser between dry cleaning operations. The dispenser may also be produced as a refillable dispenser. Such dispensers and containment bags are disclosed in currently co-pending application Ser. No. 08/665,469, the contents of which are incorporated by reference.

In yet a further embodiment of the invention there is provided a system, optionally in kit form which includes a containment bag as described above, a quantity the liquid cleaning composition as taught herein, and a dispensing container. The dispensing container may take a variety of forms, including a variety of known devices including resealable bottles with or without dispensing elements such as manually pumpable dispensers, bottles or flasks supplied with flow directing nozzles, as well as being supplied with recloseable caps. Aerosol type dispensing containers may also be used. The dispensing containers may also be of known single opening types, including sealed pouches or packages wherein the package's integrity is destroyed once it is opened and the complete contents are expected to be used subsequent to opening. Such include, for example sealed pouches formed of single layer or multilayer constructions, particularly constructions which utilize one or more polymeric films, as well as single opening ampoules, flasks or vials which once opened are not designed to be readily recloseable. Single use dispensing containers are advantageously used as they permit for the packaging of controlled amounts of the cleaning compositions being taught herein which are subsequently to be used by the consumer.

In accordance with a further aspect of the invention, there is provided a system optionally in kit form which includes a containment bag as described above, a quantity the liquid cleaning composition as taught herein, and a dispenser means.

An exemplary dispenser means is one which is formed of a porous material which is suited to be impregnated with the liquid cleaning composition according to the invention. In one aspect according to this embodiment, the porous dispenser may be one or more spherical or other generally ball-shaped dispensers formed of a porous material which is adapted for the retention of the cleaning composition within, yet when subjected to sudden motion and agitation such as is expected in a drying apparatus, release their impregnated cleaning composition. Of course, other configurations such as disks, cubes, or other geometries are also useful and may be produced, however a spherical geometry is preferred as being least likely to be undesirably snagged or trapped by tumbling garments or textiles during the cleaning process where it is present within the containment bag which assures the likelihood that a more even delivery of the cleaning composition to the garments and textiles occurs. Such a dispenser being of a porous nature permits for the flow of the cleaning composition from its interior to the exterior of the dispenser, i.e., its surface such that it may deliver the cleaning composition to a garment or textile by physical contact therewith. Materials which may be used for the production of such a porous dispenser include foamed polymeric materials which are resilient and flexible, as well as certain porous but less resilient constructions formed from polymeric materials, such as may be formed by sintering polymeric material. Useful polymers for such constructions may be based on virtually any polymer which may be formed into such a porous dispenser means, of which polyolefins, and polyamides, especially polyalkylenes including polyethylene, polybutylene and polypropylene are advantageously used. Porous dispenser means may be produced by sintering a quantity of comminuted polymer particles, such as in the forms of pellets, powders, prills or the like under appropriate conditions to agglomerate the polymer particles into a formed article which nonetheless retains a porous nature. An especially useful polymer for this purpose is a polyolefin such a high density polyethylene which is readily commercially available at a reasonable cost, and which is readily sinterable to form such a porous dispenser. It is to be understood however, that other polymers may be used.

The advantage of such porous dispenser means are that they may be produced as both a single use dispenser and disposed after a single dry cleaning operation or it may be produced as a refillable and multi-use dispenser wherein the consumer may refill the dispenser between dry cleaning operations by reimpregnating the porous dispenser with the cleaning composition such as by immersing the dispenser in a volume of said cleaning composition. Such systems which include a containment bag as described above, a quantity the liquid cleaning composition as taught herein, and porous dispenser means are disclosed in currently co-pending applications having Ser. Nos. 08/665,470, and 08/665,453 the contents of which are incorporated herein by reference.

In accordance with a yet further aspect of the invention, there is provided a system optionally in kit form which includes a containment bag having an absorbent interior surface as is described above, a quantity the liquid cleaning composition as taught herein. In accordance with such a system, the liquid cleaning composition is provided to the absorbent interior of the containment bag and the containment bag is further provided with one or more textiles or garments to be treated in accordance with the process being taught herein. The absorbent interior which is advantageously a fibrous or fleecy material acts both to distribute the liquid cleaning composition to the garments and the to trap or entrain loosened soils from the treated garments. Such a system is disclosed in currently co-pending application Ser. No. 08/665,475 the contents of which are herein incorporated by reference.

As used throughout this specification and in the claims, the use of the terms "garments" and "textiles" are used to describe for example finished articles such as pants, shirts, blouses, scarves, other articles of clothing, apparel, coats, and the like. In the case of the former term, while in the case of the latter term, textiles which are produced but have not been as of yet produced into either pieced goods or finished articles such as articles of clothing or apparel is intended to be meant by the latter term. In either case, as the present invention is equally applicable and useful without distinction or regard for both textiles and/or garments, they are to be understood as to interchangeable terms with respect to the cleaning operations and cleaning compositions according to the instant invention.

What is to be understood by the term as "dryer" or "dryer apparatus" is a rotary dryer which generally is typical of a domestic rotary dryer. The only requirement is that the drum be configured so as to retain garments and/or textiles therein, to be rotatable, and that the interior of the drum may be heated to at least the temperature at which the lowest boiling point constituent volatilizes. Domestic clothes dryers, as well as commercial clothes dryers, particularly of the rotary type and most particularly those which rotate about a non-vertical axis are to be clearly understood as encompassed within the scope of the instant invention.

As used throughout this specification and claims, references to "parts by weight" and "weight percent" and "% wt." are considered to be interchangeable and to represent the weight percent of a particular constituent with reference to a total composition within which it is included, where such total composition is considered to have 100 parts by weight. In accordance with the immediately preceeding description, all of the constituents of each of the formulations described in the examples below are recited in parts by weight and are based on 100 parts by weight of a particular formulation, unless specified to be otherwise.

EXAMPLES

To demonstrate the compositions according to the invention, various formulations were prepared having the constituents which are indicated on Table 1 below wherein the amounts given are the weight percent of each respective constituent.

Preparation of the formulations were performed in a routine manner, which was generally in accordance with the following protocol. To a large glass beaker placed on a magnetic stirrer apparatus was added less than the total amount, or the total amount of deionized water. The temperature of the water, as well as that of the remaining constituents was approximately room temperature (≅68° F., ≅20° C.) The stirrer apparatus was activated, and to the water was added measured amounts of each of the constituents. While order of addition of the constituents is not believed to be important, generally the surfactants were added to the stirring water and allowed to become well dispersed prior to the addition of the remaining constituents. After the addition of the final constituent, the contents of the beaker were allowed to stir for a period of 5 to 15 minutes to ensure homogeneous mixing and the production of a uniform formulation. Each of the formulations was observed to be shelf stable for period of weeks and months.

TABLE 1

| constituent: | Ex. 1 | Ex. 2 | Ex. 3 | Ex. 4 | Ex. 5 | Ex. 5A | Ex. 6 | Ex. 7 | Ex. 8 |
|---|---|---|---|---|---|---|---|---|---|
| PolyTergent SL-62 | 0.10 | 0.10 | 0.10 | 0.10 | 0.10 | 0.10 | 0.10 | 0.074 | 0.074 |
| PolyTergent SL-22 | 0.02 | 0.02 | 0.02 | 0.02 | 0.02 | 0.02 | 0.02 | 0.015 | 0.015 |
| Surfynol 104A | — | — | — | — | — | — | — | — | — |
| Surfynol 61 | — | — | — | — | — | — | — | — | — |
| Zonyl FS300 | — | — | — | — | — | — | — | — | — |
| ethanol | 2.0 | 2.0 | 2.0 | 2.0 | 2.0 | 2.0 | 2.0 | 3.0 | 2.0 |
| Monawet SNO-35 | 0.16 | 0.16 | 0.16 | 0.16 | 0.16 | 0.16 | 0.16 | 0.16 | 0.16 |
| Kathon CG/ICP | — | 0.05 | — | — | — | — | — | — | — |
| Kathon CG/ICP II | — | — | 0.05 | — | — | — | — | — | — |
| Busan 1504 | — | — | — | 0.10 | — | — | — | — | — |
| Dowicil 75 | — | — | — | — | 0.10 | — | — | — | — |
| Dantogard Plus | — | — | — | — | — | 0.10 | — | — | — |
| deionized water | to 100 | to 100 | to 100 | to 100 | to 100 | to 100 | to 100 | to 100 | to 100 |

| constituent: | Ex. 9 | Ex. 10 | Ex. 11 | Ex. 12 | Ex. 13 | Ex. 14* | Ex. 15* |
|---|---|---|---|---|---|---|---|
| PolyTergent SL-62 | 0.10 | 0.10 | 0.10 | 0.10 | 0.10 | 0.10 | 0.10 |
| PolyTergent SL-22 | 0.02 | 0.02 | 0.02 | 0.02 | 0.02 | 0.02 | 0.02 |
| Surfynol 104A | 0.12 | — | — | — | — | — | — |
| Surfynol 61 | — | 0.06 | — | — | — | — | — |
| Zonyl FS300 | — | — | 0.15 | — | — | — | — |
| ethanol | 2.0 | 2.0 | 2.0 | 2.0 | 2.0 | 2.0 | 5.0 |
| Monawet SNO-35 | — | — | — | 0.16 | 0.16 | 0.16 | 0.16 |
| Kathon CG/ICP | — | — | — | — | — | — | — |
| Kathon CG/ICP II | — | — | — | — | — | — | — |
| Busan 1504 | — | — | — | — | — | — | — |
| Dowicil 75 | — | — | — | — | — | — | — |
| Dantogard Plus | — | — | — | — | — | 0.1 | 0.15 |
| fragrance | — | — | — | — | — | 0.2 | 0.2 |
| deionized water | to 100 | to 100 | to 100 | to 100 | to 100 | to 100 | to 100 |

*the composition of Ex. 14 and Ex. 15 also included 0.193% wt. anhydrous sodium citrate, and 0.004 anhydrous citric acid as buffers

TABLE 2

| | |
|---|---|
| PolyTergent SL-62 | alkoxylated linear aliphatic alcohol [100% wt. actives] |
| PolyTergent SL-22 | alkoxylated linear aliphatic alcohol [100% wt. actives] |
| Surfynol 104A | nonionic surfactant [50% wt. actives] |
| Surfynol 61 | nonionic surfactant [100% wt. actives] |
| Zonyl FS300 | fluorosurfactant [50–100% wt. actives] |

TABLE 2-continued

| | |
|---|---|
| Monawet SNO-35 | a tetrasodium salt of N-(1,2,dicarboxyethyl)N-octadecyl sulfosuccinamate [35% wt. actives] |
| Kathon CG/ICP, Kathon CG/ICP | proprietary preservative composition |
| Busan 1504 | proprietary preservative composition |
| Dowicil 75 | proprietary preservative composition |
| Dantogard Plus | proprietary preservative composition |
| fragrance | proprietary fragrance composition |
| ethanol | ethanol [100% wt. actives] |
| deionized water | deionized water |

Utilizing the example formulations described in detail on Table 1, cleaning tests were performed in order to evaluate their efficacy.

Cleaning Example 1

An evaluation of the properties of the formulation according to Example 6 was performed in accordance with the following general protocol.

A clean off-white 100% silk blouse as stained in with 0.003 grams of a lipstick composition. The stain was permitted to set for 15 minutes so to simulate an actual consumer staining condition. Subsequently, a clean disposable paper towel was laid on a hard nonabsorbent surface and the stain was laid facing the paper towel. A quantity of a spot cleaning composition according to copending application Ser. No. 08/666,690, was applied to the silk fabric surface using an absorbent tipped dispenser in a brush stroking fashion to impart linear strokes. In such a fashion, the major portion of the spot cleaning composition was supplied to the locus of the stain and lesser amounts of the spot cleaner were supplied to the edges beyond the stain. In such a manner, a "feathered" application of the spot cleaning composition was provided. It is to be noted that a circular or swirling application pattern was not applied to the blouse in order to minimize the likelihood of deforming the textile. The spot cleaning composition was applied in such a manner until a substantial portion of the lipstick stain was loosened and transferred to the paper towel, and the silk blouse inspected. A minor amount of the lipstick was observed to still be present at the location of the stain.

Immediately subsequent, a quantity of the formulation according to Example 6 was applied to evenly wet the area of the lipstick stain and the thus treated garment was supplied to the interior of a containment bag formed of a vapor impermeable material. The bag was sealed, and inserted into the interior of a horizontally rotating domestic dryer apparatus. The said apparatus was activated to operate on a "low" cycle for 30 minutes, and the containment bag and its contents were removed. The silk blouse which had an overall moist appearance was then hung on a hanger and permitted to dry.

Inspection of the location of the treated stain revealed no discernible stain or residue.

The thus treated silk blouse could be lightly ironed subsequent to cleaning in order to remove any wrinkles from the garment.

It is to be understood that other spot cleaning compositions, may be used in place of that utilized above. It is further to be understood that the process as described could be performed on a garment or textile without a spot cleaning treatment step wherein a general cleaning and freshening effect is desired.

Cleaning Example 2

The efficacy of the liquid cleaning composition according to the invention and the process described above was evaluated in a process wherein the "freshening" of a garment was a primary objective to be desired.

According to this example, two identical ladies' blouses made of a 60% acetate/40% rayon blend were utilized. To the interior of first a containment bag formed of a single layer vapor impermeable polymer film were provided a small amount, i.e., "two squirts" from a hand-holdable trigger dispenser, of an aqueous 0.2% isovaleric acid composition which was provided to simulate body odor. To a second identical containment bag, a identical amount of the aqueous acid composition was also provided. Subsequently one of each blouses were provided to the interior of the containment bags which were thereafter sealed. The blouses were allowed to remain in these bags for a period of 10 minutes; this allowed for the conditioning of the blouses with the acid composition such that the blouses became malodoured.

As a "comparative" example, one of the blouses was removed, introduced into a second new containment bag of the same a single layer vapor impermeable polymer film construction which was subsequently sealed. Afterwards this containment bag and its contents were provided to the interior of a domestic dryer apparatus which was operated for 20 minutes on a "fluff" cycle; no heat was applied. The containment bag was then removed, its contained blouse was also removed and the blouse was laid on a hard surface from whence it could be compared by a panel of individuals as to its appearance and odiferous characteristics.

The second blouse was removed from the bag containing the acid composition and it was introduced into the interior of a new containment bag of the same a single layer vapor impermeable polymer film construction as used to produce the comparative example blouse. To this containment bag was also provided a single, approximately 2½ inch square, compressible polymeric foam cube which had been provided with 30.03 grams of a liquid cleaning composition according to Example 12, after which the containment bag was sealed. In a like manner to that described with reference to the comparative example blouse, the containment bag and its contents were inserted into the interior of a dryer apparatus which was operated for 20 minutes on the same fluff cycle after which the containment bag and its contents were removed. During this step, it was observed that the containment bag was found to billow, and its contents was effectively tumbled within.

After opening of the containment bag, the blouse was removed from said containment bag and laid side-by-side with the comparative example blouse for comparison of its visual and odiferous characteristic. The foam cube was removed and it was determined that consequent to the 20 minutes of tumbling, that it had released approximately 59% of the liquid home dry cleaning composition which it had originally contained, namely 17.69 grams of its liquid cleaning composition, which was further apparent from the appearance of the blouse which was damp to the touch.

These two blouses were compared; and it was observed that the blouse treated with the composition according to Example 12 had a significantly reduced level of malodor than the first, control blouse.

Cleaning Example 3

An evaluation of the properties of the liquid cleaning compositions according to the formulation of Example 13 was performed in accordance with the following general protocol.

A clean white rayon blouse was applied at one location with 3 grams of a spot cleaning formulation according to co-pending application Ser. No. 08/666,690 which was applied with a pipette. The spot cleaning formulation was allowed to spread and thus formed a wetted circular area. The spot cleaning formulation was then manually worked in by stroking it in using a clean absorbent paper towel so to ensure that it was well interspersed among the fibers of the white rayon blouse.

Subsequently, a small quantity of a liquid cleaning composition according to Example 13 was applied to this wetted area as well as in the surrounding area with a hand-holdable bottle with a manually pumpable spray dispenser bottle so to wet both the area treated by the spot cleaning formulation and its surrounding vicinity. Subsequently, the thus treated blouse was inserted into the interior of a containment bag which was formed of a single-layer polymeric material which was then sealed, and it with its contents were inserted into a domestic dryer. The dryer was operated on a "low" setting for 30 minutes where it was observed that the bag was found to billow, and the white rayon blouse was effectively tumbled within.

The bag was then removed, and the blouse was withdrawn and observed. The blouse was damp to the touch, and it was observed that no yellowing or any residual deposits were discernible in the area of application of the spot cleaning composition.

Cleaning Example 4

An evaluation of the properties of the formulation according to Example 14 as utilized in the process described above was evaluated in accordance with the following general protocol.

A clean red-colored knitted sweater, having a fiber content of 70% lambswool, 20% angora, and 10% nylon, and indicated by the manufacturer as "dry clean only" on its label was laid on a hard flat surface. To four non-contiguous regions of the sweater were applied 0.2 grams of a liquid make-up composition, 0.0015 grams of a lipstick composition, 0.10 grams of a tomato sauce composition and 0.10 grams of a salad dressing compositions. These stains were permitted to set in to the garment overnight.

As a control evaluation, a duplicate garment as described above, i.e., a "control sweater", was stained in the same manner and likewise these stains were permitted to set overnight.

The following morning, the control garment was sent off to a commercial dry cleaning establishment where it was processed according to convention methods and returned at a later date.

The remaining sweater was laid with the stained surface down upon laying of absorbent paper towels and through the obverse side, or back side of the sweater from the stained areas were applied a sufficient quantity of a spot cleaning composition according to co-pending application Ser. No. 08/660,690. This spot cleaning composition was applied utilizing an absorbent tip dispenser in a brush stroking fashion to impart linear strokes; application of the spot cleaning composition continued until it was observed that substantially all of the stains were removed from the stained garment and transferred to the clean paper towel which acted as an absorbing and stain entraining substrate. It is to be noted that cleaning the stains using the spot cleaning composition through the obverse side of the sweater did not force the migration of the soil or stain through the textile, but rather forced the stains directly from the sweater's surface to the surface of the paper towel.

Subseqently was provided a single, approximately 2½ inch square, compressible polymeric foam cube which had been provided with 29.83 grams of a liquid cleaning composition according to Example 14 described above. This liquid cleaning composition was ideally suited for the home dry cleaning process described herein. This cube was lightly dabbed in the regions of the areas wherein the spot cleaning composition had been applied, particularly at the peripheries thereof in order to "feather" these wetted areas. Immediately thereafter, the cube and the thus treated red sweater was inserted into a containment bag formed of a non-vapor permeable material which was then sealed. The sealed containment bag and its contents were then inserted into the interior of a domestic dry cleaning apparatus which was then operated on a "fluff" cycle for 20 minutes to allow the tumbling of both the red sweater and the liquid cleaning composition entrained polymeric foam cube during this interval. During this time, no heat was applied to the new bag or its contents by the dryer apparatus, and the containment bag was observed to expand or billow which permitted effective tumbling of the foam cube and the contained red sweater.

Subsequently, the containment bag was withdrawn from the dryer apparatus its contents were also removed and examined. It was observed that 53% wt. (or 15.76 grams) of the liquid cleaning composition of Ex. 14 had been released from the cube during the treatment process. The visual appearance and the odiferous characteristics of this thus cleaned red sweater were observed. It was noted that no shrinkage or color change was apparent to this garment, but that it was damp to the touch. It was also observed that each of the four stains formed by the liquid make-up, lipstick, tomato sauce and salad dressing were all totally removed and further that there were no discernible residues or residual fronts from the stained spot cleaning composition. While the sweater was slightly damp to the touch, it did not require ironing and could be hung to dry on a conventional clothes dryer. No unpleasant scent was observed.

This sweater was compared to the control sweater which had been cleaned by a conventional dry cleaning establishment. Also, no shrinkage or color change was observed in this garment, and the four stains were also effectively removed.

By comparison, it can be seen then that the use of the liquid compositions and the processes being taught herein are very favorably comparable to that which is provided by a conventional dry cleaning apparatus, but notably the compositions and processes of the invention may be practiced by a consumer in a much shorter span of time and in the convenience and approved sanitary environment of their own dryer apparatus.

Cleaning Example 5

An evaluation of the properties of the formulation according to Example 14 as utilized in the process described above was evaluated in accordance with the following general protocol.

A clean white blouse, having a fiber content of 6% acetate and 40% rayon and designated by the manufacturer as "dry clean only" on its label was laid on a hard flat surface. To four non-contiguous regions of the sweater were applied 0.2 grams of a liquid make-up composition, 0.0015 grams of a lipstick composition, 0.10 grams of a tomato sauce composition and 0.10 grams of a salad dressing compositions. These stains were permitted to set in to the garment overnight.

As a control evaluation, an identical clean white blouse as described above, i.e., a "control blouse", was stained in the same manner and likewise these stains were permitted to set overnight.

The following morning, the control blouse was sent off to a commercial dry cleaning establishment where it was processed according to convention methods and returned at a later date.

The remaining blouse was laid with the stained surface down upon laying of absorbent paper towels and through the obverse side, or back side of the sweater from the stained areas were applied a sufficient quantity of a spot cleaning composition according to co-pending application Ser. No. 08/666,690. This spot cleaning composition was applied utilizing an absorbent tip dispenser in a brush stroking fashion to impart linear strokes; application of the spot cleaning composition continued until it was observed that substantially all of the stains were removed from the stained garment and transferred to the clean paper towel which acted as an absorbing and stain entraining substrate. It is to be noted that cleaning the stains using the spot cleaning composition through the obverse side of the sweater did not force the migration of the soil or stain through the textile, but rather forced the stains directly from the sweater's surface to the surface of the paper towel.

Subseqently was provided a single, approximately 2½ inch square, compressible polymeric foam cube which had been provided with 29.61 grams of a liquid cleaning composition according to Example 14 described above. This liquid cleaning composition was ideally suited for the home dry cleaning process described herein. This cube was lightly dabbed in the regions of the areas wherein the spot cleaning composition had been applied, particularly at the peripheries thereof in order to "feather" these wetted areas. Immediately thereafter, the cube and the thus treated blouse was inserted into a containment bag formed of a non-vapor permeable material which was then sealed. The sealed containment bag and its contents were then inserted into the interior of a domestic dry cleaning apparatus which was then operated on a "fluff" cycle for 20 minutes to allow the tumbling of both the blouse and the liquid cleaning composition entrained polymeric foam cube during this interval. During this time, no heat was applied to the new bag or its contents by the dryer apparatus, and the containment bag was observed to expand or billow which permitted effective tumbling of the foam cube and the contained blouse.

Subsequently, the containment bag was withdrawn from the dryer apparatus its contents were also removed and examined. It was observed that 57% wt. (or 16.81 grams) of the liquid cleaning composition of Ex. 14 had been released from the cube during the treatment process. The visual appearance and the odiferous characteristics of this thus cleaned blouse were observed. It was noted that no shrinkage or color change was apparent to this garment, but that it was damp to the touch. It was also observed that each of the four stains formed by the liquid make-up, lipstick, tomato sauce and salad dressing were essentially totally totally removed and further that there were no readily discernible residues or residual fronts from the stained spot cleaning composition. While the sweater was damp, almost moist to the touch, but did not require ironing and could be hung to dry on a conventional clothes dryer. No unpleasant scent was observed.

This blouse was compared to the control blouse which had been cleaned by a conventional dry cleaning establishment. Also, no shrinkage or color change was observed in the control blouse, and the four stains were also effectively removed.

As in the prior cleaning example, it can be readily appreciated tha the use of the liquid compositions and the processes being taught herein are very favorably comparable to that which is provided by a conventional dry cleaning apparatus, but notably the compositions and processes of the invention may be practiced by a consumer in a much shorter span of time and in the convenience and approved sanitary environment of their own dryer apparatus.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. A home dry cleaning composition adapted to be applied to textiles or garments in a home dry cleaning process which process includes the step of contacting said composition with a textile or garment within the interior of a containment bag during tumbling in a dryer apparatus, wherein said home dry cleaning composition comprises, based on a total weight of 100%:

0.01–5% by weight of a nonionic surfactant;

0.01–2.5% by weight of an anionic surfactant selected from the group consisting of alkyl ether sulfosuccinates, alkylamide sulfosuccinates, alkyl sulfosuccinamates, and salt forms thereof;

0–1% by weight of a flurosurfactant;

0.01–7% by weight of an organic solvent selected from the group consisting of alcohols and glycol ethers;

0–2% by weight of one or more constituents selected from the group consisting of coloring agents, fragrances, fragrance adjuvents, fragrance solublizers, viscosity modifying agents, thickeners, gelling agents, optical brightening agents, pH adjusting agents, pH buffers, water softening agents, biocides and preservatives;

and water to 100% by weight.

2. The home dry cleaning composition according to claim 1 wherein the nonionic surfactant is a water soluble nonionic alkoxylated phenol.

3. The home dry cleaning composition according to claim 1 wherein the nonionic surfactant is a water soluble nonionic alkoxylated alcohol.

4. The home dry cleaning composition according to claim 3 wherein the nonionic surfactant is a water soluble nonionic alkoxylated primary alcohol, or a water soluble nonionic secondary alcohol.

5. The home drying cleaning composition according to claim 1 wherein the nonionic surfactant is present in an amount of from 0.05 to 1.0 weight percent.

6. The home dry cleaning composition according to claim 5 wherein the nonionic surfactant is present in an amount of from 0.1 to 0.15 weight percent.

7. The home dry cleaning composition according to claim 1 wherein the anionic surfactant is an alkyl ether sulfosuccinate or salt thereof.

8. The home dry cleaning composition according to claim 1 wherein the anionic surfactant is an alkylamide sulfosuccinate or salt thereof.

9. The home dry cleaning compositions according to claim 1 wherein the anionic surfactant is an alkyl sulfosuccinamate or salt thereof.

10. The home dry cleaning composition according to claim 1 wherein the anionic surfactant is present in an amount of from 0.01 to 2.0 weight percent.

11. The home dry cleaning composition according to claim 10 wherein the nonionic surfactant is present in an amount of from 0.01 to 1.0 weight percent.

12. The home dry cleaning composition according to claim 1 which comprises a fluorosurfactant.

13. The home dry cleaning composition according to claim 12 wherein the organic solvent constituent consists of a water soluble alcohol.

14. The home dry cleaning composition according to claim 12 wherein the organic solvent constituent consists of a glycol ether.

15. The home dry cleaning composition according to claim 1 wherein the organic solvent is present in an amount of from 0.05 to 4 weight percent.

16. The home dry cleaning composition according to claim 15 wherein the organic solvent is present in an amount of from 1.0 to 3.0 weight percent.

17. The home dry cleaning composition according to claim 1 wherein water forms at least 90% by weight of the total composition.

18. A home dry cleaning composition consisting essentially of:

0.01–2.5% wt. nonionic alkoxylated alcohol, 0.01–2.5% wt. anionic surfactant selected from alkyl sulfosuccinates, alkyl ether sulfosuccinates, alkylamide sulfosuccinates, alkyl sulfosuccinamates, and salt forms thereof, fluorosurfactant present at a concentration of 0.1% wt. or less, 0.01–7% wt. organic solvent selected from alcohols and glycol ethers, 0–1% wt. optional constituents, to 100% wt. water.

19. A home dry cleaning composition according to claim 18 wherein the optional constituents are one or more constituents selected from pH adjusting agents, fragrances, fragrance adjuvants and solubilizers, preservatives, coloring agents, and optical brighteners.

20. A process for home dry cleaning of a textile or garment which comprises the steps of:

contacting the textile or garment with an amount of the home dry cleaning composition according to claim 1 during tumbling in a dryer apparatus.

21. The process according to claim 20 which comprises the further process step of:

pretreating a stain on the textile or garment with a spot cleaning composition prior to contacting the textile or garment with the home dry cleaning composition.

22. The process according to claim 20 which includes the further process steps of:

inserting the textile or garment into the interior of a containment bag, providing a quantity of the home dry cleaning composition to the interior of the containment bag, closing the containment bag, inserting the containment bag containing the textile or garment to the interior of a dryer apparatus, and, operating the dryer apparatus to tumble and contact the home dry cleaning composition with the surface of the textile or garment contained in the containment bag.

23. The process according to claim 22 which includes the further process step of:

providing a dispenser means.

24. The process according to claim 23 wherein the dispenser means is a separable ball shaped dispenser which includes a vessel for the containment of a quantity of the home dry cleaning composition, as well as fluid communication means between the interior of the vessel and the exterior of the dispenser.

25. The process according to claim 23 wherein the dispenser means is a porous dispenser means.

26. The process according to claim 23 wherein the porous dispenser means is a resilient polymeric material.

27. The process according to claim 23 wherein the porous dispenser means is sintered polymeric material.

28. The process according to claim 23 wherein the dispenser means is an absorbent interior surface of the containment bag.

29. The process according to claim 23 wherein the dispenser means is a dispensing container.

30. The process according to claim 23 wherein the dispensing container is a resealable bottle.

31. The process according to claim 23 wherein the dispensing container is a bottle provided with a dispensing pump.

32. The process according to claim 23 wherein the dispensing container is a single use sealed pouch containing a quantity of the home dry cleaning composition.

33. A process for home dry cleaning of a textile or garment which comprises the steps of:

contacting the textile or garment with the home dry cleaning composition according to claim 18 during tumbling in a dryer apparatus.

34. A home dry cleaning kit which includes a containment bag, a quantity of the home dry cleaning composition according to claim 1, and a dispenser means for dispensing the home dry cleaning composition to garments or textiles.

35. A home dry cleaning kit which includes a containment bag, a quantity of the home dry cleaning composition according to claim 18, and a dispenser means for dispensing the home dry cleaning composition to garments or textiles.

* * * * *

UNITED STATES PATENT AND TRADEMARK OFFICE

CERTIFICATE OF CORRECTION

PATENT NO. : 5,865,851

DATED : February 2, 1999

INVENTOR(S) : Anthony Domenic SIDOTI; Michael Richard TYERECH; Tracy Ann RYAN; Frank Anthony LUCIA III; Jeanne Marie WELLER It is certified that error appears in the above-identified patent and that said Letters Patent is hereby corrected as shown below:

On the title page, insert the following:

--[30] Foreign Application Priority Data

March 7, 1996 [GB] Great Britain.....9604849.1--

Signed and Sealed this

Thirteenth Day of July, 1999

*Attest:*

*Attesting Officer*

Q. TODD DICKINSON

*Acting Commissioner of Patents and Trademarks*